US006215352B1

(12) United States Patent
Sudo

(10) Patent No.: US 6,215,352 B1
(45) Date of Patent: Apr. 10, 2001

(54) REFERENCE VOLTAGE GENERATING CIRCUIT WITH MOS TRANSISTORS HAVING A FLOATING GATE

(75) Inventor: Naoaki Sudo, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/236,331

(22) Filed: Jan. 25, 1999

(30) Foreign Application Priority Data

Jan. 28, 1998 (JP) ..... 10-015667

(51) Int. Cl.[7] ..... G05F 1/10

(52) U.S. Cl. ..... 327/530; 365/185.18; 365/185.24

(58) Field of Search ..... 327/530, 539, 327/540; 323/313, 315; 365/185.01, 185.09, 185.18, 185.24, 185.29

(56) References Cited

U.S. PATENT DOCUMENTS

| | | | | |
|---|---|---|---|---|
| 4,498,040 | * | 2/1985 | Tatsushi et al. | 323/299 |
| 5,218,571 | * | 6/1993 | Norris | 365/211 |
| 5,629,893 | * | 5/1997 | Tang et al. | 365/185.29 |

FOREIGN PATENT DOCUMENTS

| | | |
|---|---|---|
| 59-212927 | 12/1984 | (JP) . |
| 60-1018 | 1/1985 | (JP) . |
| 61-21515 | 1/1986 | (JP) . |
| 1-296491 | 11/1989 | (JP) . |
| 2-90307 | 3/1990 | (JP) . |
| 2-245810 | 10/1990 | (JP) . |
| 2-245913 | 10/1990 | (JP) . |
| 5-119859 | 5/1993 | (JP) . |
| 7-50563 | 2/1995 | (JP) . |
| 8-211953 | 8/1996 | (JP) . |
| 9-7380 | 1/1997 | (JP) . |

* cited by examiner

*Primary Examiner*—Jung Ho Kim
(74) *Attorney, Agent, or Firm*—Sughrue, Mion, Zinn, Macpeak & Seas, PLLC

(57) ABSTRACT

A reference voltage generating circuit with MOS transistors having a floating gate is disclosed. The reference voltage generating circuit has first and second MOS transistors in which substantially the same current flows by means of a current mirror circuit. The differential voltage between the threshold voltages of the first and second MOS transistors is applied from the source of the first transistor as the reference voltage. The first and second transistors are of a construction that includes a floating gate, and the threshold voltage can be set to any value by means of the amount of charge injected to the floating gate.

18 Claims, 3 Drawing Sheets

REFERENCE VOLTAGE GENERATING CIRCUIT WITH MOS TRANSISTORS HAVING A FLOATING GATE

BACKGROUND OF THE INVENTION

1. Field of the Invention

The present invention relates to a reference voltage generating circuit mounted on a semiconductor integrated device for generating a reference voltage that exhibits little fluctuation caused by external variations.

2. Description of the Related Art

In semiconductor integrated devices, there is a risk that circuit operation within the semiconductor integrated device may undergo changes due to fluctuations in the outside power supply voltage or outside temperature. In analog circuits in particular, external fluctuations may cause unstable circuit operation, resulting in malfunctioning. A reference voltage having little fluctuation caused by external variations is therefore essential. One example of a reference voltage generating circuit for generating a reference voltage that is relatively unaffected by external fluctuation is described in Japanese Patent Laid-open No. 296491/89.

FIG. 1 shows a circuit diagram of this type of reference voltage generating circuit of the prior art.

This reference voltage generating circuit comprises p-channel MOS transistors 11–13, n-channel MOS transistors 21–24, 45, and 46, and resistor 1.

P-channel MOS transistor 11 has its source connected to power supply voltage VCC and its gate connected to reference voltage generating circuit activating signal BVREF. In this case, reference voltage generating circuit activating signal BVREF is low-level (hereinbelow abbreviated "L") when activating the reference voltage generating circuit and high-level (hereinbelow abbreviated "H") when deactivating the reference voltage generating circuit. Resistor 1 is connected between the drain of p-channel MOS transistor 11 and the drain of n-channel MOS transistor 23. N-channel MOS transistor 23 has its gate and drain connected together, and has its source connected to ground. N-channel MOS transistor 21 has its gate connected to the gate of n-channel MOS transistor 23, thereby constituting together with n-channel MOS transistor 23 a current mirror circuit.

P-channel MOS transistor 12 has its gate and drain connected together, and has its source is connected to VCC, and has its drain connected to the drain of n-channel MOS transistor 21. P-channel MOS transistor 13 has its source connected to VCC, and its gate connected to the gate of p-channel MOS transistor 12, thereby constituting together with p-channel MOS transistor 12 a current mirror circuit. N-channel MOS transistor 45 has its drain connected to the drain of p-channel MOS transistor 13, and its gate and drain connected together. N-channel MOS transistor 46 has its drain connected to the drain of p-channel MOS transistor 13, its gate and drain connected together, and its source connected to ground. The threshold voltages of n-channel MOS transistors 45 and 46 are set to differing values, designated $VT_{45}$ and $VT_{46}$, respectively. N-channel MOS transistor 22 has its drain connected to the source of n-channel MOS transistor 45, its source connected to ground, and its gate connected to the gate of n-channel MOS transistor 23. The gate width of n-channel MOS transistor 22 is set to one-half that of n-channel MOS transistors 21 and 23 since that when the gate voltage is the same, one-half the current of n-channel MOS transistors 21 and 23 flows across the drain and source.

In the prior-art reference voltage generating circuit, the source voltage of n-channel MOS transistor 45 is obtained as reference voltage VREF.

N-channel MOS transistor 24 has its gate which reference voltage generating circuit activating signal BVREF is applied to, its source grounded, and its drain connected to the gate of n-channel MOS transistor 23.

N-channel MOS transistor 24 serves to render the gate voltage of n-channel MOS transistors 21, 22, 23 L when the operation of the reference voltage generating circuit is halted at the time reference voltage generating circuit activating signal BVREF has become H.

The operation of the reference voltage generating circuit of the prior art will be explained below.

To operate the reference voltage generating circuit, reference voltage generating circuit activating signal BVREF is first rendered L to turn on p-channel MOS transistor 11 and turn off n-channel MOS transistor 24.

Current I, which is determined by resistor 1 and n-channel MOS transistor 23, then flows across the drain and source of n-channel MOS transistor 23 to generate voltage $V_1$, which is a voltage lower than power supply voltage VCC. The voltage $V_i$ is applied to the gate of n-channel MOS transistor 21 to cause current 21 to flow across the source and drain of n-channel MOS transistor 21. In n-channel MOS transistor 22 as well, voltage $V_1$ is applied to its gate to cause current I, which is one-half the current of current 2I, to flow across the source and drain. Current I also flows across the drain and source of n-channel MOS transistor 45. Since provision is made for a current mirror circuit that allows current of the same level to flow to p-channel MOS transistor 12 and p-channel MOS transistor 13, current 2I will also flow across the source and drain of p-channel MOS transistor 13.

The drain of n-channel MOS transistor 45 and the drain of n-channel MOS transistor 46 are both connected to the drain of n-channel MOS transistor 13, which operates as a constant-current source. Accordingly current I (2I–I=I) of the same level that flows to n-channel MOS transistor 45 flows to n-channel MOS transistor 46.

Assuming that n-channel MOS transistors 45 and 46 both operate in the transistor saturation range, the current flowing across the drain and source of each will be equal, realizing the following equation:

$$\beta_{45}/2\times(V_2-VREF-|VT_{45}|)=\beta_{46}/2\times(V_2-|VT_{46}|)$$

Were, $\beta_{45}$ and $\beta_{46}$ are the conductance coefficients of n-channel MOS transistors 45 and 46, respectively, and $V_2$ is the drain voltage of p-channel MOS transistor 13.

If $\beta_{45}$ and $\beta_{46}$ are substantially equal, $|VT_{46}|-|VT_{45}|$, which is the differential voltage of the threshold values of each of n-channel MOS transistors 45 and 46, is obtained as reference voltage VREF, which is the output from the source of n-channel MOS transistor 45. The value VREF depends solely on the difference between the threshold voltages of n-channel MOS transistor 45 and n-channel MOS transistor 46. As a result, the value of reference voltage VREF exhibits almost no change despite fluctuation in the threshold values of MOS transistors caused by external temperature or variation in the transistor threshold value when fabricating a semiconductor device.

A reference voltage generating circuit of the prior art, however, has the problem that only a particular fixed generated reference voltage VREF can be produced because the threshold values of n-channel MOS transistors 45 and 46 are fixed. Moreover, the reference voltage generating circuit of the aforementioned prior art also has the problem that variation in the characteristics of circuit elements at the time of fabrication results in variation in the obtained reference voltage, with the consequence that a reference voltage of a desired voltage cannot be obtained.

SUMMARY OF THE INVENTION

It is an object of the present invention to provide a reference voltage generating circuit in which a reference voltage having any value can be obtained.

To realize the aforementioned object, the reference voltage generating circuit according to the present invention comprises a first MOS transistor whose gate and drain are connected together, and a second MOS transistor whose gate and drain are connected together and which has a threshold value differing from the first MOS transistor.

Current of substantially the same level is flown to both the first and second MOS transistors by means of a current mirror circuit, and the source voltage of the first MOS transistor is obtained as the reference voltage.

According to one embodiment of the present invention, at least one MOS transistor of the first and second MOS transistors is of a construction that includes a floating gate. The threshold voltage of the two MOS transistors can therefore be set to any value, whereby the voltage value of the reference voltage can be set to any value.

According to another embodiment of the present invention, the reference voltage generating circuit of the invention further includes means for controlling the amount of charge injected into the floating gate of a MOS transistor having a floating gate to alter the threshold voltage. This embodiment therefore allows the voltage value of the reference voltage to be freely reset after fabrication or after shipping.

The above and other objects, features, and advantages of the present invention will become apparent from the following description with reference to the accompanying drawings which illustrate examples of the present invention.

DETAILED DESCRIPTION OF THE PREFERRED EMBODIMENTS

First Embodiment

Figure 1:
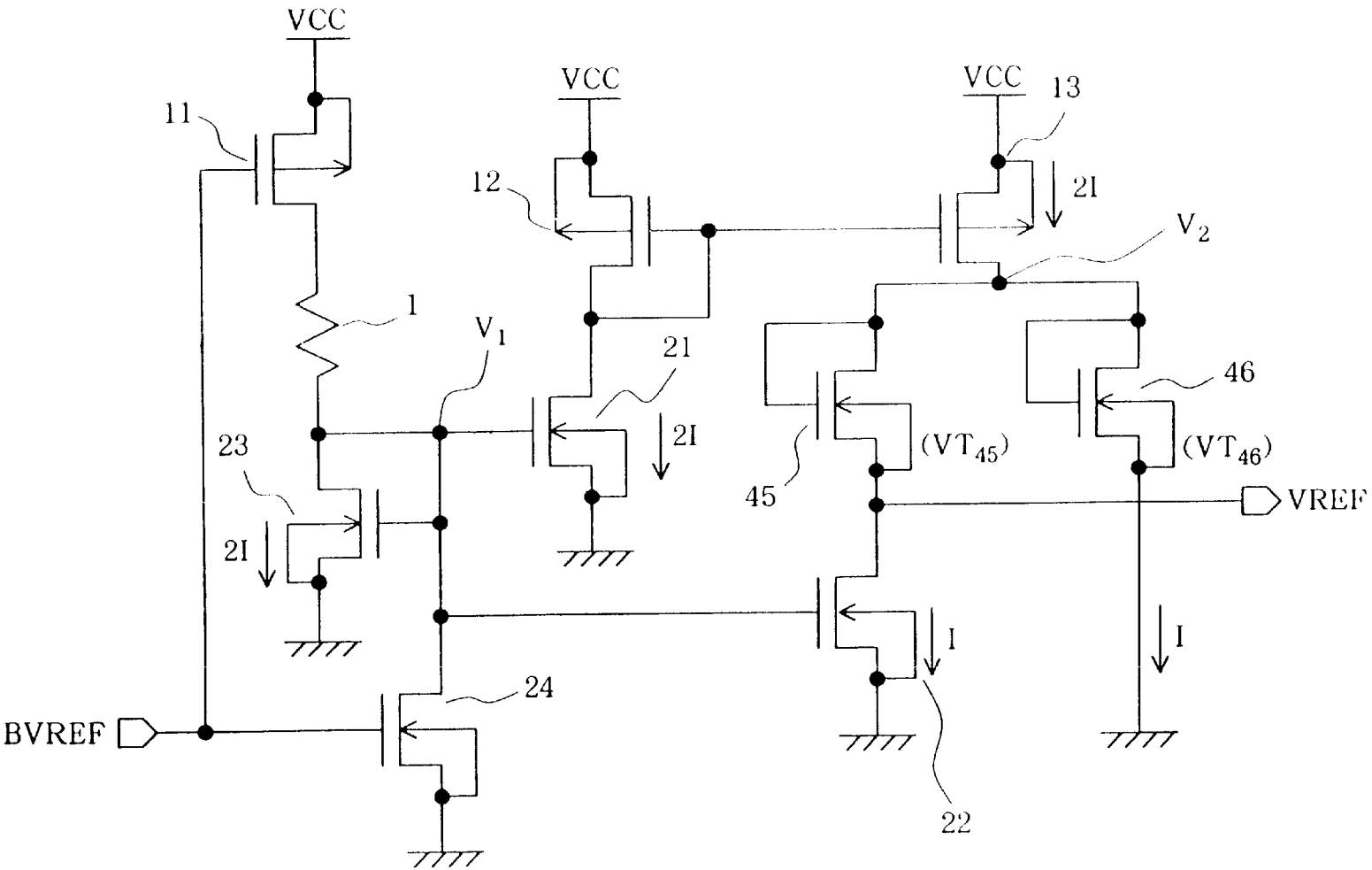
Fig. 1 PRIOR ART
FIG. 1 is a circuit diagram showing a reference voltage generating circuit of the prior art.
Figure 2:
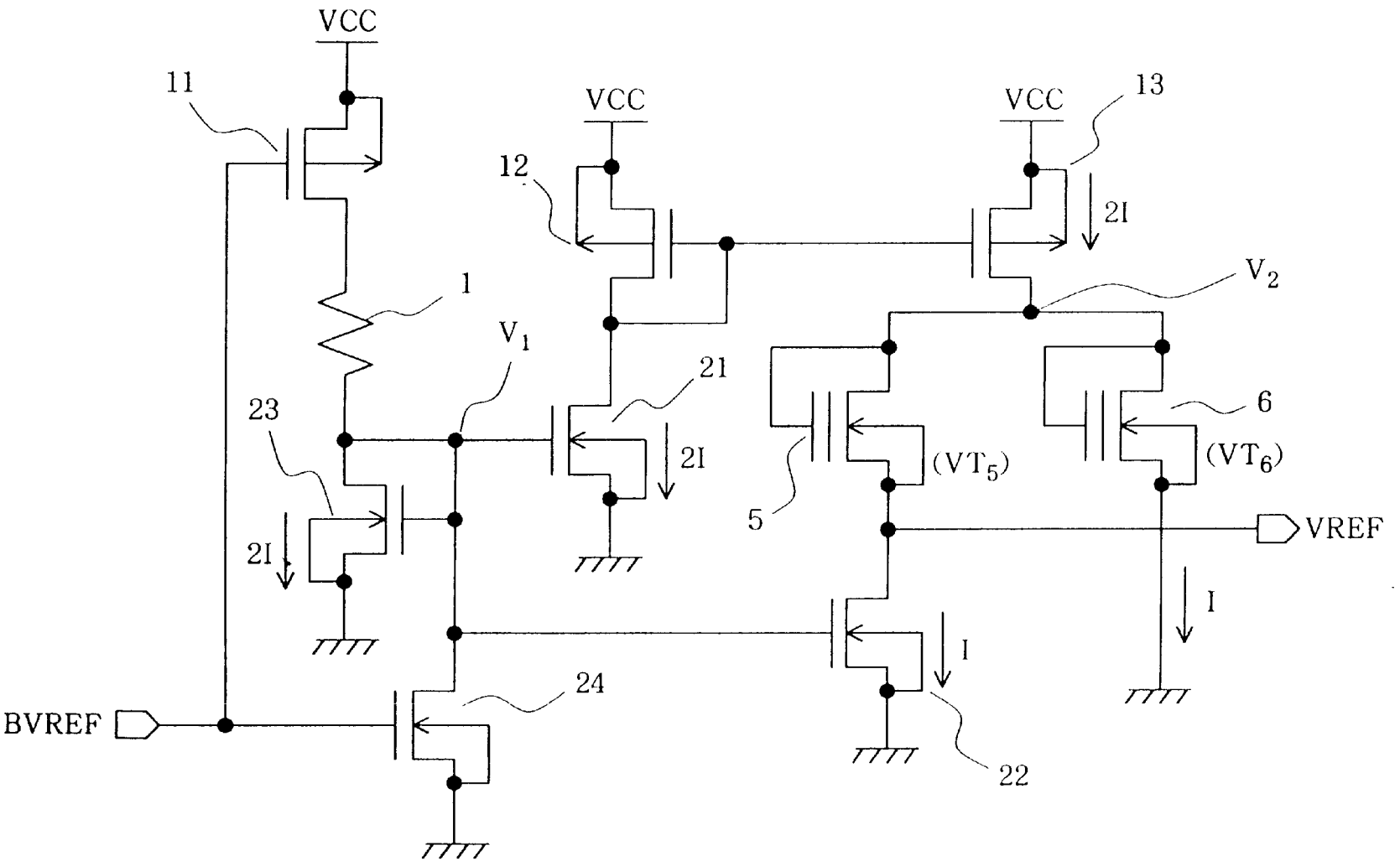
FIG. 2 is a circuit diagram showing the reference voltage generating circuit according to a first embodiment of the present invention.

Referring to FIG. 2, the reference voltage generating circuit according to this embodiment includes n-channel MOS transistors 5 and 6 having floating gates in place of n-channel MOS transistors 45 and 46 in the reference voltage generating circuit of the prior art shown in FIG. 1, respectively.

The threshold voltages of floating-gate n-channel MOS transistors 5 and 6 are set to differing values, designated $VT_5$ and $VT_6$, respectively.

The operation of this embodiment is equivalent to that of the prior-art example shown in FIG. 1 with the exception that the differential voltage $|VT_6|-|VT_5|$ of the threshold voltages of floating-gate n-channel MOS transistors 5 and 6 is provided as reference voltage VREF.

Since the threshold voltages of the floating-gate n-channel MOS transistors 5 and 6 change with the amount of charge injected to the floating gates, the voltage values $VT_6$ and $VT_5$ of the threshold voltages can be freely set and the value of reference voltage VREF, which is the differential voltage of these voltage values can also be set to any value.

Second Embodiment

Figure 3:
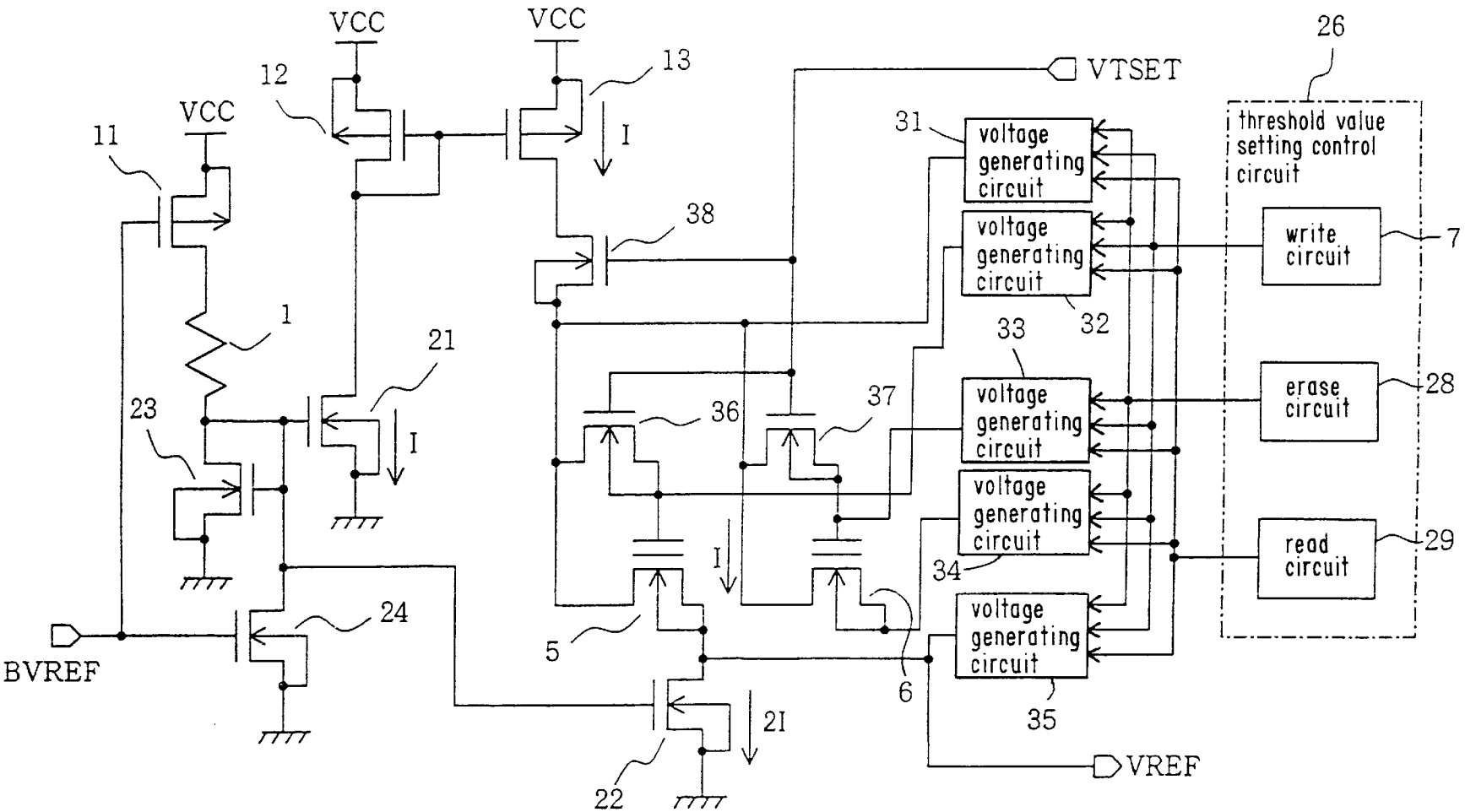
FIG. 3 is a circuit diagram showing the reference voltage generating circuit according to a second embodiment of the present invention.

A second embodiment of the present invention will be explained below with the reference to FIG. 3.

This embodiment of the reference voltage generating circuit includes n-channel MOS transistors 36–38 and voltage generating circuits 31–35 for setting the amount of charge injected to the floating gates of floating-gate n-channel MOS transistors 5 and 6 of the first embodiment of the reference voltage generating circuit shown in FIG. 2, and in addition, further includes a threshold value setting control circuit 26. N-channel MOS transistor 38 is connected between the drain of p-channel MOS transistor 13 and the drain of floating-gate n-channel MOS transistor 5, and has its gate to which threshold value setting signal VTSET is applied.

Threshold value setting signal VTSET becomes L when setting the threshold voltages of floating-gate n-channel MOS transistors 5 and 6, and becomes the VPP level when operating to generate reference voltage VREF. In this case, the VPP level is a voltage level sufficient to turn on n-channel MOS transistors 36, 37, and 38.

N-channel MOS transistor 36 is connected between the gate and drain of floating-gate n-channel MOS transistor 5, and n-channel MOS transistor 37 is connected between the gate and drain of floating-gate n-channel MOS transistors 6, and threshold value setting signal VTSET is applied to the gate of each of n-channel MOS transistors 36 and 37.

When setting the threshold voltage, n-channel MOS transistors 36, 37, and 38 are turned off with the change of threshold value setting signal VTSET to L, whereby the gates and drains of floating gate n-channel MOS transistors 5 and 6 are disconnected, and p-channel MOS transistor 13 and floating-gate n-channel MOS transistor 5 are also disconnected.

During normal operations in which reference voltage VREF is generated, threshold value setting signal VTSET is changed to the VPP level to turn off (n-channel MOS transistors 36, 37, and 38. Thus, operation is carried out equivalent to that of the reference voltage generating circuit shown in FIG. 2.

Threshold value setting control circuit 26 comprises a write circuit 27, an erase circuit 28, and a read circuit 29. Write circuit 27, erase circuit 28, and read circuit 29 each effect control such that voltage generating circuits 31–35 output prescribed voltages during writing, erasing, and reading, respectively.

Voltage generating circuit 31 applies voltage to the drains of n-channel MOS transistors 5 and 6, voltage generating circuit 32 applies voltage to the gate of n-channel MOS transistor 5, voltage generating circuit 33 applies voltage to the gate of n-channel MOS transistor 6, voltage generating circuit 34 applies voltage to the source of n-channel MOS transistor 6, and voltage generating circuit 35 applies voltage to the source of n-channel MOS transistor 5. Voltage generating circuit 34 produces the GND level potential during normal operation in which threshold value setting signal VTSET is of the VPP level, and applies the GND level potential to the source of floating gate n-channel MOS transistor 6, thereby eliminating the need to connect the source of floating gate n-channel MOS transistor 6 to GND.

Table 1 below presents an example of voltages produced in each of the modes by voltage generating circuits 31–35 under the control of write circuit 27, erase circuit 28, and read circuit 29.

TABLE 1

| Mode | Drain Voltage generating circuit 31 | Gate Voltage generating circuits 32, 33 | Source Voltage generating circuits 34, 45 |
|---|---|---|---|
| Write | 6 V | 12 V | GND |
| Erase | Open | GND | 12 V |
| Read | VCC | 6 V | GND |

The operation of this embodiment will be explained below with reference to FIG. 3.

Threshold value setting signal VTSET is first switched from VPP level to L level to place the reference voltage generating circuit in a threshold voltage setting state. Control is then effected by threshold value setting control circuit 26 as follows. To raise the threshold voltages of floating-gate n-channel MOS transistors 5 and 6, voltages for writing are selected, 12 V being applied to each of the gates, 6 V being applied to each of the drains, and GND level being applied to each of the sources. Similarly, voltages for erasing are applied to each of the gates, drains, and sources of floating gate n-channel MOS transistors 5 and 6 to lower the threshold voltages. The threshold voltage of floating-gate n-channel MOS transistors 5 and 6 can thus be varied.

When reading out and verifying the threshold values, voltages for reading are applied to each of the gates, drains, and sources of floating-gate n-channel MOS transistors 5 and 6. Although not shown in the figures, the read voltage values may be verified by using, for example, sense amplifiers.

The voltage values of 12 V and 6 V are given herein by way of examples, and equivalent operation can be realized using other voltage values. In addition, the threshold voltages of both of floating-gate n-channel MOS transistors 5 and 6 need not be changed at the same time, and a desired reference voltage VREF may be generated by changing only one of the voltages.

Finally, threshold value setting signal VTSET is switched from the L to the VPP level to place the reference voltage generating circuit in a normal operation state.

The reference voltage generating circuit according to this embodiment has the same technical merit as the reference voltage generating circuit according to the first embodiment described hereinabove, and in addition, enables resetting of the voltage value of reference voltage VREF produced because the threshold voltages of floating-gate n-channel MOS transistors 5 and 6 can be altered.

Although explanation thus far has been given regarding the first and second embodiments using the figures, the present invention is not limited to these descriptions and can be similarly applied in the cases described hereinbelow.

In a reference voltage generating circuit in which the difference in the threshold voltages of two MOS transistors having differing threshold values is produced as the reference voltage, the circuit configuration may take any form as long as at least one of the two MOS transistors is a transistor having a floating gate. The present invention can be realized even if the power supply voltage and ground are switched and the conductivity is reversed in the circuit configurations of the first and second embodiments. The threshold value setting method described in the second embodiment may take another form such as irradiation by ultraviolet light.

While preferred embodiments of the present invention have been described using specific terms, such description is for illustrative purposes only, and it is to be understood that changes and variations may be made without departing from the spirit or scope of the following claims.

What is claimed is:

1. A reference voltage generating circuit comprising:

a first MOS transistor having a floating gate and the gate and drain connected together, for producing source voltage as a reference voltage;

a second MOS transistor having its gate and drain connected together and having a threshold voltage differing from that of said first MOS transistor; and a current mirror circuit connected to both of said first and second MOS transistors, wherein a current of substantially the same level flows in said first and second MOS transistors.

2. A reference voltage generating circuit according to claim 1 further comprising means for controlling the amount of charge to be injected to the floating gate of said first MOS transistor to alter the setting of threshold voltage.

3. A reference voltage generating circuit according to claim 2 wherein said means for controlling the amount of charge comprises:

a plurality of voltage generating means for applying prescribed voltages to the gate, drain, and source of said first MOS transistor, when injecting charge to said floating gate, when eliminating charge from said floating gate, and when verifying threshold voltage, respectively;

threshold voltage setting control means for instructing each of said voltage generating means to inject charge to said floating gate, eliminate charge from said floating gate, and verify threshold voltage;

a first switch for switching the connection states between said first MOS transistor and said current mirror circuit; and a second switch for switching the connection states between the gate and drain of said first MOS transistor.

4. A reference voltage generating circuit comprising:

a first MOS transistor having its gate and drain connected together, for producing source voltage as a reference voltage;

a second MOS transistor having a floating gate and the gate and drain connected together and having a threshold voltage differing from that of said first MOS transistor; and a current mirror circuit connected to both of said first and second MOS transistors, wherein a current of substantially the same level flows in said first and second MOS transistors.

5. A reference voltage generating circuit according to claim 4 further comprising means for controlling the amount of charge to be injected to the floating gate of said second MOS transistor to alter the setting of threshold voltage.

6. A reference voltage generating circuit according to claim 5 wherein said means for controlling the amount of charge comprises:

a plurality of voltage generating means for applying prescribed voltages to the gate, drain, and source of said second MOS transistor, when injecting charge to said floating gate, when eliminating charge from said floating gate, and when verifying threshold voltage, respectively;

threshold voltage setting control means for instructing each of said voltage generating means to inject charge to said floating gate, eliminate charge from said floating gate, and verify threshold voltage;

a first switch for switching the connection states between said second MOS transistor and said current mirror circuit; and a second switch for switching the connection states between the gate and drain of said second MOS transistor.

7. A reference voltage generating circuit comprising:

a first MOS transistor having a floating gate and the gate and drain connected together, for producing source voltage as a reference voltage;

a second MOS transistor having a floating gate and the gate and drain connected together and having a threshold voltage differing from that of said first MOS transistor; and a current mirror circuit connected to both of said first and second MOS transistors, wherein a current of substantially the same level flows in said first and second MOS transistors.

8. A reference voltage generating circuit according to claim 7 further comprising means for controlling the amount of charge to be injected to the floating gate of said first and second MOS transistors to alter the setting of threshold voltage.

9. A reference voltage generating circuit according to claim 8 wherein said means for controlling the amount of charge comprises:

a plurality of voltage generating means for applying prescribed voltages to the gate, drain, and source of said first and second MOS transistor, when injecting charge to said floating gate, when eliminating charge from said floating gate, and when verifying threshold voltage, respectively;

threshold voltage setting control means for instructing each of said voltage generating means to inject charge to said floating gate, eliminate charge from said floating gate, and verify threshold voltage;

a first switch for switching the connection states between said first and second MOS transistors and said current mirror circuit;

a second switch for switching the connection states between the gate and drain of said first MOS transistor; and a third switch for switching the connection states between the gate and drain of said second MOS transistor.

10. A reference voltage generating circuit comprising:

a first MOS transistor having a floating gate and the gate and drain connected together, for producing the source voltage as a reference voltage;

a first constant-current source provided between said first MOS transistor and the ground for generating current of a predetermined fixed current value;

a second MOS transistor having its gate and drain connected together, and its source connected to the ground, and having a threshold voltage differing from that of said first MOS transistor; and a second constant-current source for generating current of substantially twice the current value of the current generated by said first constant-current source and having one terminal connected in common to the drains of said first and said second MOS transistors and the other terminal connected to a power supply voltage.

11. A reference voltage generating circuit according to claim 10 further comprising means for controlling the amount of charge to be injected to the floating gate of said first MOS transistor to alter the setting of threshold voltage.

12. A reference voltage generating circuit according to claim 11 wherein said means for controlling the amount of charge comprises:

a plurality of voltage generating means for applying prescribed voltages to the gate, drain, and source of said first MOS transistor, when injecting charge to said floating gate, when eliminating charge from said floating gate, and when verifying threshold voltage, respectively;

threshold voltage setting control means for instructing each of said voltage generating means to inject charge to said floating gate, eliminate charge from said floating gate, and verify threshold voltage;

a first switch for switching the connection states between said first MOS transistor and said second constant-current source; and a second switch for switching the connection states between the gate and drain of said first MOS transistor.

13. A reference voltage generating circuit comprising:

a first MOS transistor having its gate and drain connected together, for producing the source voltage as a reference voltage;

a first constant-current source provided between said first MOS transistor and the ground for generating current of a predetermined fixed current value;

a second MOS transistor having a floating gate and the gate and drain connected together, and its source connected to the ground, and having a threshold voltage differing from that of said first MOS transistor; and a second constant-current source for generating current of substantially twice the current value of the current generated by said first constant-current source and having one terminal connected in common to the drains of said first and said second MOS transistors and the other terminal connected to a power supply voltage.

14. A reference voltage generating circuit according to claim 13 further comprising means for controlling the amount of charge to be injected to the floating gate of said second MOS transistor to alter the setting of threshold voltage.

15. A reference voltage generating circuit according to claim 14 wherein said means for controlling the amount of charge comprises:

a plurality of voltage generating means for applying prescribed voltages to the gate, drain, and source of said second MOS transistor, when injecting charge to said floating gate, when eliminating charge from said floating gate, and when verifying threshold voltage, respectively;

threshold voltage setting control means for instructing each of said voltage generating means to inject charge to said floating gate, eliminate charge from said floating gate, and verify threshold voltage;

a first switch for switching the connection states between said second MOS transistor and said second constant-current source; and a second switch for switching the connection states between the gate and drain of said second MOS transistor.

16. A reference voltage generating circuit comprising:

a first MOS transistor having a floating gate and the gate and drain connected together, for producing the source voltage as a reference voltage;

a first constant-current source provided between said first MOS transistor and the ground for generating current of a predetermined fixed current value;

a second MOS transistor having a floating gate and the gate and drain connected together, and its source connected to the ground, and having a threshold voltage differing from that of said first MOS transistor; and a second constant-current source for generating current of substantially twice the current value of the current generated by said first constant-current source and having one terminal connected in common to the drains of said first and said second MOS transistors and the other terminal connected to a power supply voltage.

17. A reference voltage generating circuit according to claim 16 further comprising means for controlling the amount of charge to be injected to the floating gate of said first and second MOS transistor to alter the setting of threshold voltage.

18. A reference voltage generating circuit according to claim 17 wherein said means for controlling the amount of charge comprises:

a plurality of voltage generating means for applying prescribed voltages to the gate, drain, and source of said first and second MOS transistor, when injecting charge to said floating gate, when eliminating charge from said floating gate, and when verifying threshold voltage, respectively;

threshold voltage setting control means for instructing each of said voltage generating means to inject charge to said floating gate, eliminate charge from said floating gate, and verify threshold voltage;

a first switch for switching the connection states between said first and second MOS transistor and said second constant-current source;

a second switch for switching the connection states between the gate and drain of said first MOS transistor; and a third switch for switching the connection states between the gate and drain of said second MOS transistor.

* * * * *